United States Patent [19]

Petersen

[11] 4,156,449

[45] May 29, 1979

[54] SHIELD APPARATUS

[76] Inventor: Ross K. Petersen, 4701 Humboldt Ave. North, Minneapolis, Minn. 55430

[21] Appl. No.: 821,544

[22] Filed: Aug. 3, 1977

[51] Int. Cl.[2] ..... A47G 5/02

[52] U.S. Cl. ..... 160/290 R; 160/120

[58] Field of Search ..... 160/120–122, 160/241, 369, 290; 83/649, 150; 99/451; 126/33; 225/80, 90; 242/67.1 D, 67.3, 684; 281/6, 11, 12; 282/128; 312/137, 308

[56] References Cited

U.S. PATENT DOCUMENTS

| | | | |
|---|---|---|---|
| 544,439 | 8/1895 | Landis | 51/272 |
| 886,092 | 4/1908 | Tily et al. | 225/80 |
| 1,606,971 | 11/1926 | Nelson | 281/6 |
| 2,569,337 | 9/1951 | Rice | 242/67.3 F |
| 2,736,114 | 2/1956 | Krueger | 281/6 |
| 2,882,890 | 4/1959 | Shaw | 160/241 |
| 2,894,604 | 7/1959 | McMillan | 312/137 |
| 3,817,310 | 6/1974 | Petersen | 160/369 |

*Primary Examiner*—Peter M. Caun

*Attorney, Agent, or Firm*—Burd, Braddock & Bartz

[57] ABSTRACT

A sneeze and cough shield apparatus having an elongated disposable plastic sheet material usable with a food serving table to separate the food area from the patron area over a central area. The shield apparatus has upright end supports mounted on the table for supporting a plastic sheet member. A supply roll of transparent plastic sheet material extends over a support rod carried by one end support. A second support rod is carried by the other end support. A releasable holding bar retains the free end of the plastic sheet material on the second support rod.

20 Claims, 8 Drawing Figures

34
37
36
46
47
17
23
24
26
27
28
29
31
32
33
38
39
41
42
43
44
48
49
51
52

FIG. 6
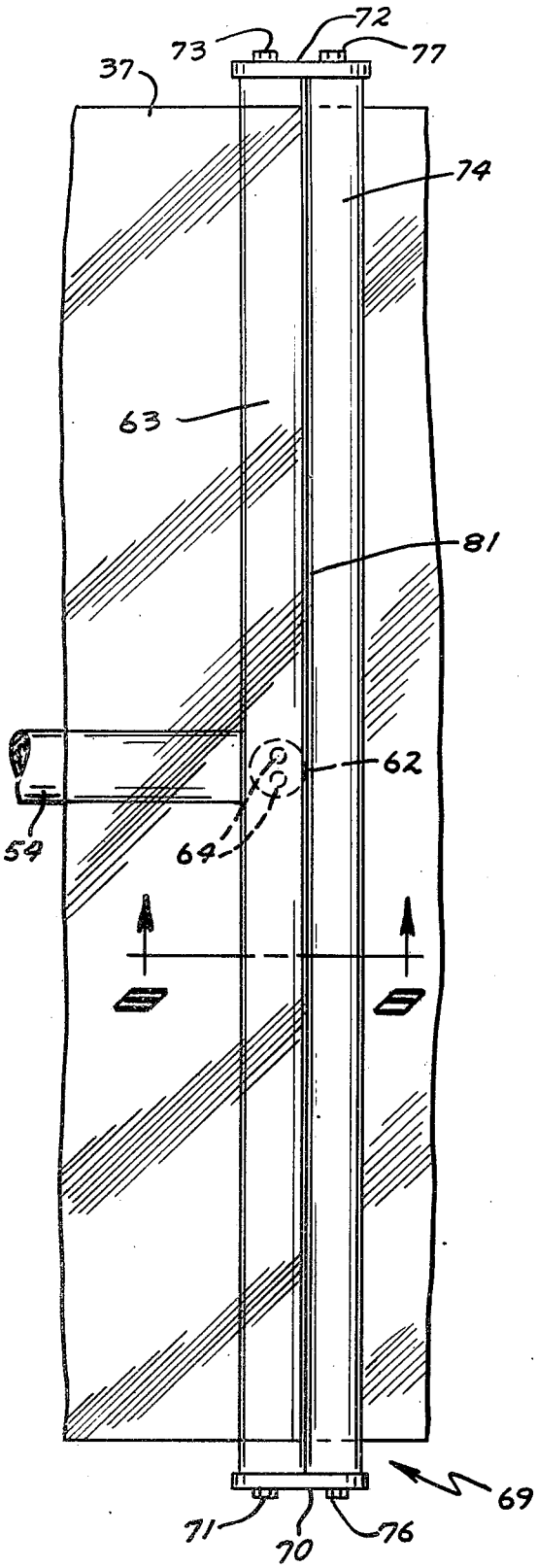
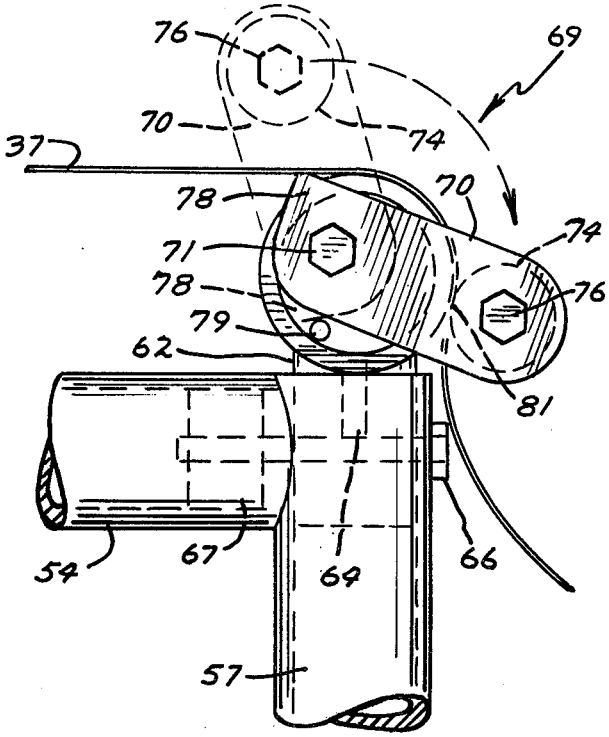
FIG. 7
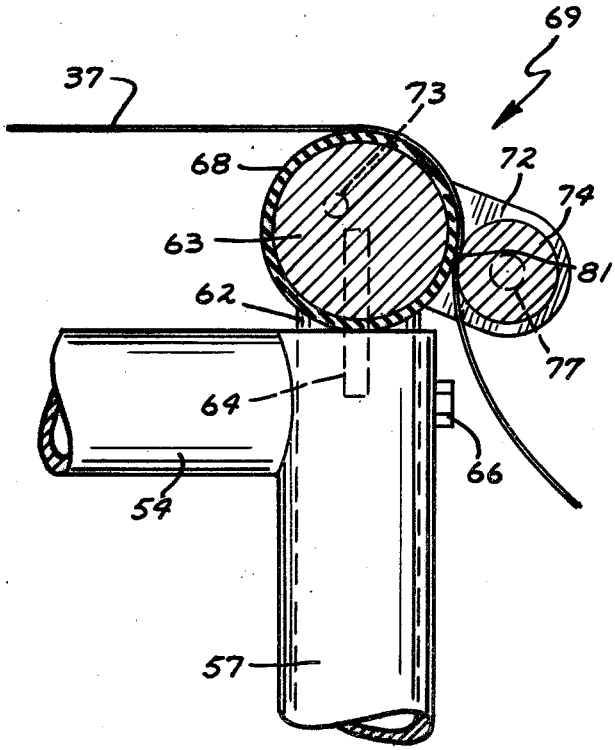
FIG. 8

SHIELD APPARATUS

BACKGROUND OF THE INVENTION

Transparent barriers and shields are used in cafeteria food service establishments to separate the food carrying pans and trays from the customers. The conventional shields are permanent curved glass or plastic panels rigidly mounted on upright supports. The panels must be cleaned and sanitized in place as they are not removable.

A removable plastic shield assembly is disclosed by Petersen in U.S. Pat. No. 3,817,310. The shield assembly has a disposable elongated transparent sheet member held in an operative position on an upwardly extending frame structure. The sheet members have elongated pockets or channels for accommodating the frame structures. They are specifically constructed to accommodate the supporting frame structures. This shield assembly does not use existing unmodified transparent plastic sheet material or film.

SUMMARY OF THE INVENTION

The invention is directed to a shield apparatus having support means for accommodating a roll of sheet material and supporting a section of the sheet material in a position to separate a first area from a second area. The support means includes a first end support having holding means for accommodating a roll of sheet material and a transverse support rod for positioning sheet material extended from the roll. A second end support has a second transverse rod for positioning the free end of the sheet material to thereby locate an elongated portion of the sheet material in a desired position. A releasable retaining means is associated with the second rod to hold the sheet material on the second rod. The releasable retaining means includes an elongated weighted bar secured to a pair of arms. Eccentric pivots rotatably mount the arms on opposite ends of the second rod whereby the weighted rod can move into a surface clamping engagement with the second rod. The holder for the roll has adjustable brake means used to maintain the tension on the sheet material extended between the first and second positioning rods.

An object of the invention is to provide an apparatus for supporting transparent sheet material extended from a roll of sheet material in a position which separates a first area from a second area. A specific purpose of the invention is to provide a sneeze and cough shield apparatus having a disposable transparent plastic film usable with a food serving structure to separate the food area from the patron area. Yet another object of the invention is to provide a shield apparatus with a first holder to support a roll of sheet material and a second holder to support the free end of the sheet material in a manner which allows the sheet material to be readily positioned on and removed from the holders. A further object of the invention is to provide a holder for sheet material that is operable to selectively retain and release an end of the sheet material. A further object of the invention is to provide a low cost disposable shield for a food serving line that is sanitary, obviates possibilities of injury to customers and contamination of the food in the food serving line and is readily and conveniently used with a minimum of time and labor. These and other objects of the invention are predicated on the shield apparatus disclosed in this application.

IN THE DRAWINGS

FIG. 1 is a perspective view of the shield apparatus of the invention associated with a food serving table to provide a transparent shield separating the food serving area from the patron area;

FIG. 6 is an enlarged top view of the holder for the free end of the sheet material;

FIG. 8 is an enlarged sectional view taken along the line 8—8 of FIG. 6.

DESCRIPTION OF PREFERRED EMBODIMENT

Figures 5, 7:
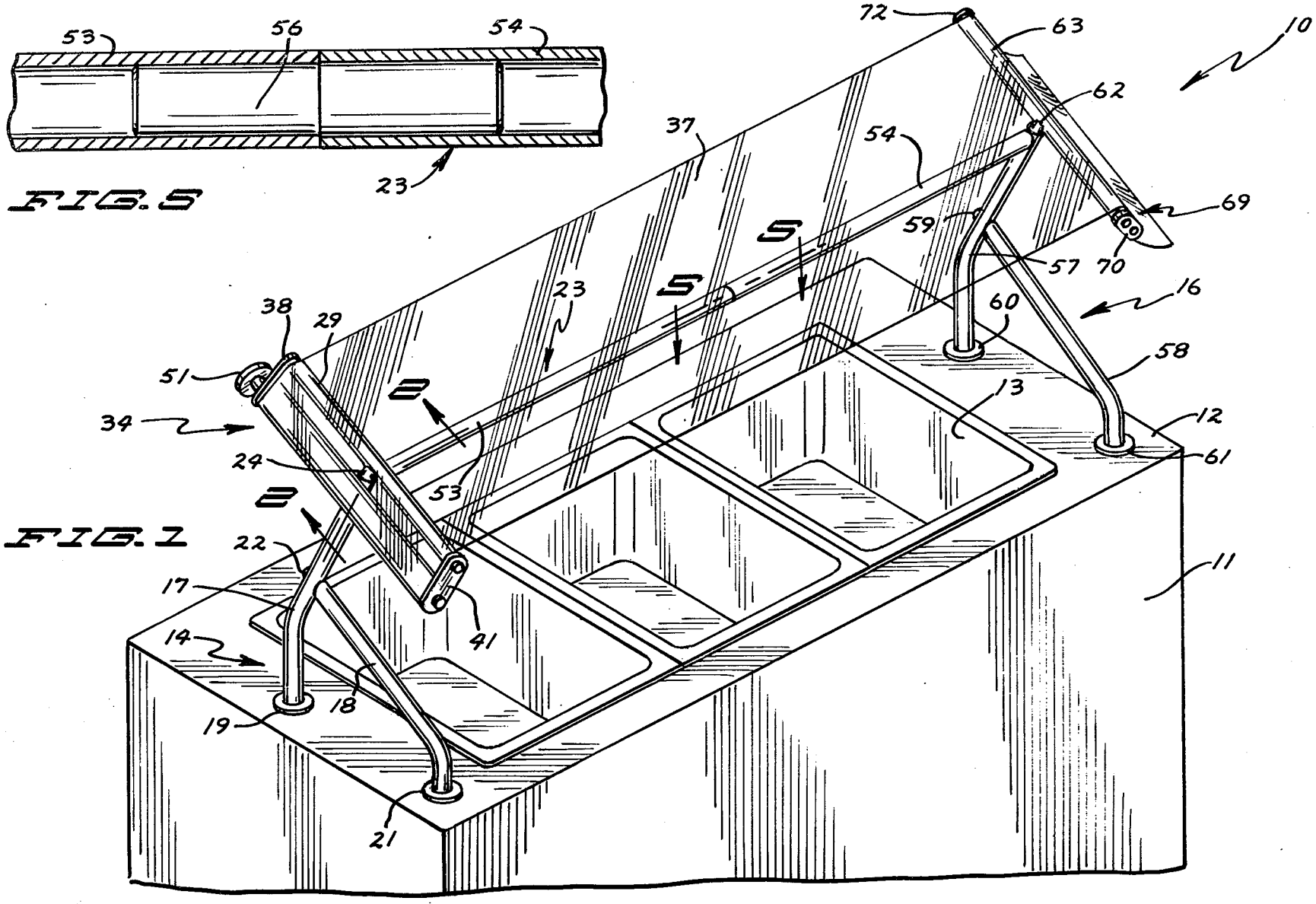
FIG. 5 is an enlarged sectional view taken along the line 5—5 of FIG. 1.
FIG. 7 is an enlarged end view of FIG. 6.

Referring to FIG. 1, there is shown the shield apparatus of the invention, indicated generally at 10, associated with a food serving table or counter 11. Table 11 has a top 12 accommodating a plurality of food serving trays or pans 13. The table 11 can have an elongated shape or can be a series of end-to-end tables such as is conventionally found in a cafeteria food line. Table 11 can also have additional trays which allow the patrons to be served from both sides of the table.

Shield apparatus 10 has a first stand or end support 14 located on one end of the top 12 and a second stand or end support 16 located on the opposite end of top 12. Stand 12 has a pair of upwardly directed legs 17 and 18 having lower downwardly directed ends that fit into sockets 19 and 21 mounted in top 12. Sockets 19 and 21 can be downwardly directed tubular members which telescopically receive the lower ends of the legs 17 and 18. The lower ends of legs 17 and 18 can be provided with support structures, such as suction cups, which can be releasably attached to the top 12. A bolt 22 attaches the upper end of leg 18 to the midportion of leg 17.

Figures 2, 3, 4:
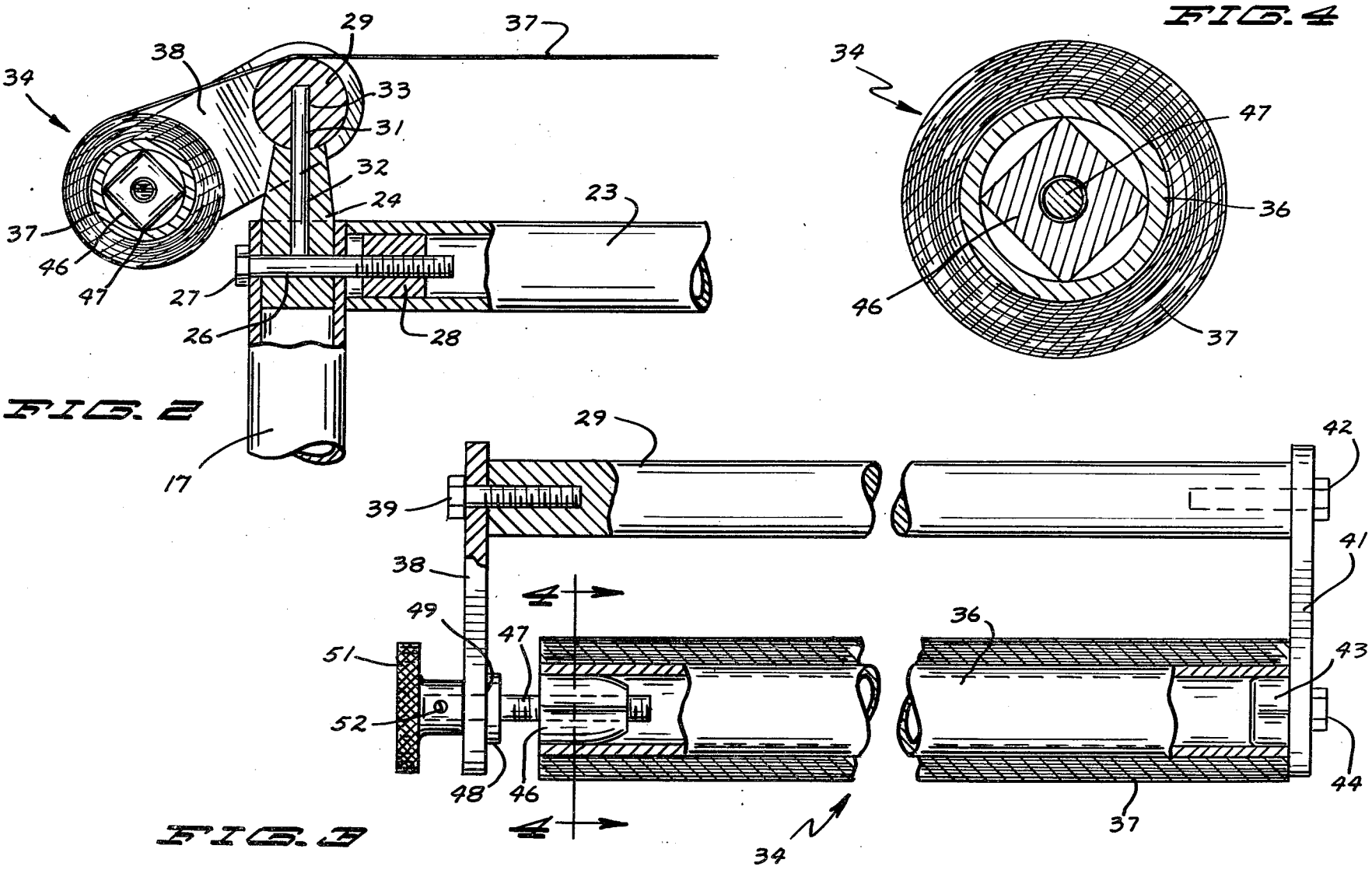
FIG. 2 is an enlarged sectional view taken along the line 2—2 of FIG. 1.
FIG. 3 is an enlarged foreshortened top view, partly sectioned, of the supply end of the shield apparatus.
FIG. 4 is an enlarged sectional view taken along the line 4—4 of FIG. 3.

An elongated longitudinal cross brace or tie member 23 extends between and is connected to the upper ends of the stands 14 and 16. As shown in FIG. 2, a short attachment plug or connector 24 fits into the upper end of leg 17. Plug 24 has a hole 26 accommodating a bolt 27. Bolt 27 is threaded into a plug 28 secured to the end of cross brace 23.

A transverse positioning rod 29 is mounted on connector 24. A pair of dowel pins or attachment pins 31 press fitted into bores 32 in connector 24 and bores 33 in rod 29 firmly secure the rod 29 to connector 24. The rod 29 is located generally parallel to the plane of the legs 17 and 18 and is generally normal to the longitudinal extent of cross brace 23. The rod 29 extends in an upwardly and rearwardly directed angle as determined by the angular position of the upper end of leg 17.

A conventional roll of transparent plastic sheet material or film, indicated generally at 34, is located adjacent the rod 29. Roll 34 has an elongated cylindrical core 36. The core 36 is a conventional paper core carrying a coil of sheet material 37 such as transparent plastic film. The film can be thin transparent polyethylene film. Other types of films can be used including but not limited to paper and transparent plastic film.

A first side plate 38 is connected with a bolt 39 to one end of rod 29. A second side plate 41 is connected with a bolt 42 to the opposite end of the rod 29. As shown in FIG. 3, a roller shaft or cylinder 43 is secured to plate 41 with a bolt 44. Cylinder 43 fits into one end of the core 36. A square stub shaft or square body 46 is forced into the opposite end of core 36 whereby the cylinder 43 and body 46 define a rotational axis in general vertical alignment with the support legs and on one side of the central area of serving trays 13. Body 46 has a central threaded opening accommodating a threaded locking member or bolt 47. Locking member 47 has an enlarged head or flange 48 which bears against the inside surface of side plate 38. The cooperating friction or braking surfaces between the head 48 and side plate 38 are identified by the number 49. Bolt 47 has an outwardly directed projection accommodating a knob 51. A set screw 52 secures knob 51 to bolt 47. Other types of connecting structure can be used to secure knob 51 to bolt 47. Knob 51 is rotated to adjust the frictional drag on the roll 34. Core 36 is forced into frictional engagement with the inside surface of side plate 41. An equal and opposite force is established between the flange 48 and the inside surface of plate 38.

The cross brace 23 comprises a pair of end-to-end tubular members 53 and 54. As shown in FIG. 5, a stepped connecting pin 56 holds the adjacent ends of tubular members 53 and 54 in assembled relation. The pin 56 can be withdrawn from the tubular member 53 to facilitate the assembly and disassembly of the cross brace 23. Additional elongated tubular members can be added to increase the length of the cross brace 23.

Returning to FIG. 1, second stand 16 has a pair of upwardly directed legs 57 and 58. The upper end of leg 58 is connected to the midsection of leg 57 with a bolt 59. The legs 57 and 58 have lower ends which extend into sockets 60 and 61 mounted on the table top 12. Supports, as suction cups, can be used to mount the lower ends of legs 57 and 58 on table top 12. A connector or attachment plug 62 is mounted on the upper end of leg 57. Plug 62 is identical to the plug 24. A bolt 66, shown in FIG. 7, threaded into plug 57 secured to the end of the cross tubular member 54, holds plug 62 in assembled relation with leg 57. A transverse positioning rod 63 is mounted on plug 62. A pair of attachment pins or dowel pins 64 secure the center portion of rod 63 to the top of plug 62 and as seen in FIG. 1 is in general vertical alignment with legs 57, 58 and lies parallel to and in lateral alignment with the film roll bearing axis on the opposite side of the central serving area.

As shown in FIG. 8, the outer surface of rod 63 is covered with a jacket or layer of resilient material 68, such as rubber or plastic. This material 68 enhances the adherence of the sheet material 37 to the rod 63.

As shown in FIGS. 6, 7 and 8, a releasable retaining means, indicated generally at 69, holds the free end of the sheet material 37 on rod 63. Releasable retaining means 69 comprises a first arm 70 secured to one end of rod 63 with a bolt 71. A second arm 72 is secured to the opposite end of rod 63 with a bolt 73. Bolts 71 and 73 are pivot members positioned off center from the center of rod 63. A transverse weighted rod 74 extends between the outer ends of arms 70 and 72. Bolts 76 and 77 secure the rod 74 to the arms 70 and 72. As shown in FIG. 7, arm 70 has a corner 78 adapted to engage an outwardly directed stop pin 79 when the arm 70 is in its up or raised position, as shown in broken lines. Arm 72 has a similar corner which engages a stop pin secured to the opposite end of rod 63. When the arms 70 and 72 engage their respective stop pins, the weighted rod 74 is in an up overcenter position spaced from an upper portion of the transverse rod 63. This facilitates the insertion or threading of the free end of the sheet material 37 over the rod 63. When the weighted rod 74 is moved in a clockwise direction to its down or holding position as shown in full lines in FIG. 7, the rod 74 is moved into wedging linear contact with a transverse portion of the sheet material 37 and thereby firmly holds the sheet material on rod 63.

In use, the first and second stands 14 and 16 are mounted on the top 12 of table 11. The transverse positioning rods 29 and 63 are inclined upwardly and rearwardly over the food serving area above the trays 13. The rods 29 and 63 are laterally spaced from each other and extend generally parallel to each other. The cross members 23 fix the lateral space between the rods 29 and 63.

The roll 34 of sheet material is positioned over the square body 46. The opposite end of the core 36 is then placed on the roll shaft 43. Knob 51 is adjusted so that the roll is free to rotate. The sheet material 37 is pulled over the first positioning rod 29 and then over the second positioning rod 63. The releasable retaining means 69 then moves to the down position as shown in full lines in FIGS. 1, 6 and 7. This clamps the free end of the sheet material on the second rod 63. The roll 34 is then rotated to apply longitudinal tension on the sheet member 37 thereby locating the sheet member in a generally flat elongated plane between the rods 29 and 63. Knob 51 is rotated to apply holding force on the roll. The body 46 forces the core 36 into frictional engagement with the arm and forces the head 48 into frictional engagement with arm 38. This frictionally retains the roll 34 in its adjusted position.

Sheet member 37 is replaced by merely cutting the sheet member adjacent the roll 34. The weighted rod 74 is moved to its up or release position. The sheet member 37 is then free to be removed from the apparatus. A new expanse of sheet material is placed in position between the rods 29 and 63 after the holding force on the roll 34 is released by rotating the knob 51.

While there has been shown and described one embodiment of the shield apparatus of the invention, it is understood that changes in the size, materials and configuration of the structures can be made by those skilled in the art without departing from the invention. For example, the lower ends of legs 17 and 18 can telescope over upright members secured to top 12. O-rings around the upright members may be used to seal and frictionally retain the legs on the upright members. The invention is defined in the following claims.

The embodiments of the invention in which an exclusive property or privilege is claimed are defined as follows:

1. A renewable sneeze shield apparatus comprising, first and second upright supports having upper and lower ends and adapted to be substantially vertically mounted upon a base in laterally spaced relation to each other on opposite sides of a central area therebetween, said first support adjacent its upper end having transversely spaced bearing means for rotatably mounting an unwindable roll of sneeze shield film material, said bearing means defining an axis, generally parallel to and adjoining a plane containing said first support and extending along one of said central area opposite sides, said bearing means further including means to control unwinding of the film material, said first support having base mounting means at its lower end, said second support having base mounting means at its lower end, said second support having a transverse member at its upper end of substantially the same width as the film material and adjoining the general vertical plane of said second support, said transverse member being disposed substantially parallel to said first support bearing means axis and disposed on the other side of said central area opposite sides substantially in lateral alignment with the bearing means, and, said member having clamping means effective along the length thereof for moving toward engagement with said transverse member or being spaced therefrom to define a gap therebetween through which said film material can pass, whereby said film material can be unwound from said roll on said first support, at one side of said opposite sides, extended in unsupported relation across said central area to said clamping means on said second support at said other side of said opposite sides, thereby to dispose a renewable sneeze shield over said central area.

2. The apparatus of claim 1 wherein said first support further includes a transverse member at the upper end thereof disposed substantially parallel to and elevated with respect to said bearing means axis, thereby to provide a guide and support for said sneeze shield film material unwound from said roll at said first support.

3. The apparatus of claim 1 wherein: the transverse member is an elongated rod extended transversely of the sheet material to transversely support the sheet material.

4. The apparatus of claim 3 further including a transverse rod on said first support disposed adjacent said bearing means to support initially unwound film.

5. The apparatus of claim 1 including: brace means extended between and connected to the first and second supports.

6. The apparatus of claim 1 wherein: the first means includes a body engageable with the roll and adjustable means operable to move the body relative to the roll to apply a friction drag to the roll.

7. The apparatus of claim 1 wherein: the first support has a transverse rod to support the sheet material, said means mounting the roll of sheet film material includes a first arm secured to one end of the rod, a second arm secured to the other end of the rod, a member secured to the first arm supporting one end of the roll, and said control means mounted on the second arm supporting the other end of the roll.

8. The apparatus of claim 7 wherein: the adjustable means includes a body engageable with the roll, and rotatable means engageable with the body to move the body relative to the roll to apply a friction drag to the roll.

9. The apparatus of claim 1 wherein: the transverse member includes a transverse rod for supporting an end of the film material, said clamping means for holding the end of the sheet material including bar-like holding means engageable with the rod to hold the sheet material on the rod, and means for mounting the holding means on the rod.

10. The apparatus of claim 9 wherein: the means for mounting the holding means on the rod includes a pair of arms secured to the holding means and pivotally connected to opposite ends of the rod.

11. The apparatus of claim 10 including: pivot means pivotally connecting the arms to the opposite ends of the rod off-center of the axis of the rod, and stop members secured to the opposite ends of the rod to limit pivotal movement of the holding means relative to the rod to fix the open position of the holding means.

12. The apparatus of claim 9 wherein: the holding means is a weighted bar extended parallel to the transverse rod.

13. The apparatus of claim 9 including: resilient material on the outer surface of the rod.

14. An apparatus for supporting a roll of sheet material and an elongated section of sheet material extended from said roll, said elongated section of sheet material separating a first area for accommodating food from a second area remote from the first area comprising:

a first upright support, a first transverse rod having a mid-section and opposite ends, first means mounting the mid-section of the first rod to the upper end of the first upright support, arm means secured to opposite ends of the first rod, means associated with the arm means for mounting the roll of sheet material on the arm means, said elongated section of sheet material extended over said first rod whereby the rod transversely supports the sheet material, a second upright support spaced from the first upright support, a second transverse rod having a mid-section and opposite ends, second means mounting the mid-section of the second rod to the second support, second arm means pivotally mounted on opposite ends of the second rod, an elongated bar connected to said second arm means engageable with the second rod to hold a portion of the sheet member in transverse engagement with the second rod, and pivot means pivotally connecting the second arm means to the opposite ends of the second rod off-center of the axis of the second rod whereby the bar can be pivoted away from the second rod to allow the sheet member to be removed from the second rod.

15. The apparatus of claim 14 including: brace means extended horizontally between and connected to the first and second supports.

16. The apparatus of claim 14 including: stop members on at least one end of the second rod to limit pivotal movement of the second arm means relative to the second rod to fix the open position of the bar above the second rod.

17. The apparatus of claim 14 including: a first member mounted on a first portion of the first arm means for supporting one end of the roll, and a second adjustable means mounted on a second portion of the first arms to support the opposite end of the roll, said adjustable means operable to apply a friction drag to the roll.

18. The apparatus of claim 17 wherein: the adjustable means includes a body engageable with the roll, and rotatable means engageable with the body to move the body relative to the roll to apply friction drag to the roll.

19. The apparatus of claim 14, including: resilient means on the outer surface of the second rod.

20. The apparatus of claim 14, wherein: the sheet material is a transparent plastic film.

* * * * *

UNITED STATES PATENT AND TRADEMARK OFFICE

CERTIFICATE OF CORRECTION

PATENT NO. : 4,156,449

DATED : May 29, 1979

INVENTOR(S) : Ross K. Petersen

It is certified that error appears in the above-identified patent and that said Letters Patent are hereby corrected as shown below:

In the Abstract, line 4, remove "over a central area".

In the Abstract, line 6, after "sheet member" insert -- over a central area --.

Column 3, line 45, delete "and as seen in FIG. 1 is in general vertical alignment with legs 57, 58 and lies parallel to and in lateral alignment with the film roll bearing axis on the opposite side of the central serving area.".

Column 3, line 42, after "A transverse positioning rod 63 is mounted on plug 62" insert -- and as seen in FIG. 1 is in general vertical alignment with legs 57, 58 and lies parallel to and in lateral alignment with the film roll bearing axis on the opposite side of the central serving area. --.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*